US005078857A

United States Patent [19]

Melton

[11] Patent Number: 5,078,857

[45] Date of Patent: Jan. 7, 1992

[54] DELAYED COKING AND HEATER THEREFOR

[76] Inventor: M. Shannon Melton, 9707 S. Richmond, Tulsa, Okla. 74137

[21] Appl. No.: 508,820

[22] Filed: Apr. 12, 1990

Related U.S. Application Data

[62] Division of Ser. No. 243,918, Sep. 13, 1988.

[51] Int. Cl.[5] ..... C10G 9/14

[52] U.S. Cl. ..... 208/132; 122/355; 122/511; 208/131; 208/50

[58] Field of Search ..... 122/208, 235 C, 235 K, 122/355, 510, 511, 512; 208/50, 131, 132

[56] References Cited

U.S. PATENT DOCUMENTS

| | | | |
|---|---|---|---|
| 2,113,331 | 4/1938 | Nash et al. | 208/132 |
| 2,190,635 | 2/1940 | Lobo | 208/132 |
| 2,207,497 | 7/1940 | Mayo | 122/493 X |
| 2,224,917 | 12/1940 | Mekler | 208/132 |
| 2,246,026 | 6/1941 | Wilson | 208/132 |
| 2,246,027 | 6/1941 | Wilson | 208/132 |
| 2,265,959 | 12/1941 | Ward | 208/132 |
| 2,332,051 | 10/1943 | Brandt | 208/132 |
| 2,418,506 | 4/1947 | Fulton | 122/355 X |
| 2,430,344 | 11/1947 | Kemp | 208/132 |
| 2,994,724 | 8/1961 | Hillard | 208/132 X |
| 3,112,880 | 12/1963 | Pollock | 208/132 X |
| 3,353,920 | 11/1967 | Kitzen | 208/132 X |
| 3,365,387 | 1/1968 | Cahn et al. | 208/132 X |
| 4,008,128 | 2/1977 | Dorner | 208/132 X |
| 4,049,538 | 9/1977 | Hayashi et al. | 208/50 |
| 4,088,184 | 5/1978 | Cavallaro | 122/510 X |
| 4,160,701 | 7/1979 | Dorner et al. | 122/235 C X |
| 4,194,966 | 3/1980 | Edison et al. | 208/132 |
| 4,361,478 | 11/1982 | Gengler et al. | 208/132 X |
| 4,412,975 | 11/1983 | Parizot et al. | 122/235 C X |
| 4,519,898 | 5/1985 | Allan | 208/50 |
| 4,522,157 | 6/1985 | O'Sullivan et al. | 122/510 |
| 4,547,284 | 10/1985 | Sze et al. | 208/131 X |
| 4,673,486 | 6/1987 | Orihashi et al. | 208/132 X |
| 4,762,958 | 8/1988 | Martens et al. | 208/132 |
| 4,777,318 | 10/1988 | Martens et al. | 208/132 |
| 4,853,106 | 8/1989 | Grove et al. | 208/50 X |
| 4,908,121 | 3/1990 | Hackemesser et al. | 208/132 X |

FOREIGN PATENT DOCUMENTS

| | | | |
|---|---|---|---|
| 12282 | 3/1848 | United Kingdom | 122/208 |

*Primary Examiner*—Henry A. Bennett
*Assistant Examiner*—Christopher Kilner
*Attorney, Agent, or Firm*—Head & Johnson

[57] ABSTRACT

A process and apparatus are disclosed for heating a coking feedstock to a temperature sufficient to effect coking of the coking feedstock in a coking drum, said process and said apparatus being characterized by the fact that the heating is conducted in a double fired heater in which the coking feedstock is heated by flames located on opposite sides of the tubing through which the feedstock flows. The process and apparatus allow for increased coke production and extended operating periods.

6 Claims, 4 Drawing Sheets

DELAYED COKING AND HEATER THEREFOR

This is a divisional of copending application Ser. No. 07/243,918 filed on 9/13/88.

FIELD OF INVENTION

The present invention relates to the production of coke from liquids containing compounds that can be cracked to produce carbon. In another aspect the present invention relates to the process known as delayed coking. In still another aspect the present invention relates to a heater for use in heating the coking feedstock that is introduced into the coking drum in a delayed coking process. In still another aspect the present invention relates to a novel tube heater.

BACKGROUND OF THE INVENTION

Coking can be considered to be a severe thermal cracking process in which one of the end products comprise carbon, i.e. coke. The delayed coking process was initially developed to minimize refinery yields of residual fuel oil by severe cracking of feedstocks such as vacuum residuals and thermal tars to produce coke and lower molecular weight hydrocarbons. U.S. Pat. Nos. 4,049,538 and 4,547,284, the disclosures of which are incorporated herein by reference, show examples of delayed coking processes.

The delayed coking process generally involves heating the feedstock in the conduit or tubing of a tube heater to a temperature above the cracking temperature while feeding the feedstock at a high velocity through the conduit. The optimum operation involves the use of feed rate such as to minimize the actual formation of carbon in the heated conduit of the tube heater. The tube heaters are often referred to interchangeably as coker heaters or coker preheaters and the terms are similarly used interchangeably in this description.

In U.S. Pat. No. 4,049,538 a coker preheater is illustrated diagrammatically as item number 11. In U.S. Pat. No. 4,547,284 a coker heater is illustrated diagrammatically as item number 25. The heated feedstock at the coking temperature is passed from the heating zone to a coke drum wherein preferably the majority of the coke formation takes place. In the insulated coke drum, or surge drum, a sufficient residence time allows the coking to take place. Typically, the heated coking feedstock has been heated to a temperature sufficient to maintain the coking in the drum, i.e. temperature in the range of about 750 to about 975 degrees fahrenheit. As the process proceeds, coke accumulates in the coking drum and is later removed by techniques known in the art.

Although much effort has been devoted in the past to providing conditions which will allow for the delayed coking feedstock to be heated to the cracking temperature without the formation of undesirable carbon deposits in the conduit of the coker heater, carbon deposition in the conduits of the coker heater still continues to be a problem.

As coke deposits in the conduit of the tube heater, the flow of feedstock through the heater is restricted. The restriction of flow can lead to increased residence time which in turn can lead to the deposition of additional coke. The coke deposits in turn tend to insulate the tube so that more heat must be applied to achieve the same rate of heating of the feedstock. In addition the coke deposits cause the tubes to become much hotter. All these factors obviously tend to encourage the formation of still more coke within the tube of the tube heater.

If the temperature of the tube gets high enough, a tube rupture can occur. The likelihood of tube rupture is also aggravated by the fact that the feed must be pumped at ever higher pressures as the flow is restricted by coke deposition in the tubes of the heater. The combination of exposing the tubes to higher temperatures and higher pressures greatly increases the probability of tube rupture and total shut down of the delayed coking process.

Because of the formation of coke deposits in the tubes of the heaters, operators in the past have had to periodically shut down the operation and remove the coke that had been formed within the tubes of the heater.

It is believed that in all the prior art coking heaters the tubes through which the coking feedstock was passed have been secured to an inner side wall of the heater. The present invention is based in part upon the discovery that this prior art arrangement actually is a contributing factor to the formation of coke within the tubes of the heater.

An object of the present invention is to provide an improved delayed coking process in which the tendency for coke lay down in the tubes of the coking heater is greatly reduced.

Another object of the present invention is to provide a more efficient heater for a delayed coking process. Still another object for the present invention is to provide a coking heater which can be operated for extended periods of time without having to be taken offstream for coke removal.

Still another object of the present invention is to provide a coking heater which can provide the desired level of heating with less overall length of heater tubing.

Still yet another object of the present invention is to provide a coking heater which allows for reduced residence time of the coking feedstock in the heater.

Other aspects, objects, and advantages of the present invention will be apparent to one having skill in the art from the following disclosure taken in conjuction with the drawings.

SUMMARY OF THE INVENTION

In accordance with the present invention there is provided an apparatus and process for heating a coking feedstock to a temperature sufficient to effect coking when the heated coking feedstock is transferred into a delayed coking drum.

The coking feedstock heater includes a heating vessel having a tube bank or sheet suspended therein. On each side of the tube bank there are a plurality of burners located so as to be capable for providing a sheet of flame on opposite sides of the tube bank.

A further understanding of the present invention and its aspects, objects and advantages will follow from a review of the specific embodiment illustrated in the accompanying figures.

DESCRIPTION OF A PREFERRED EMBODIMENT

Figure 1:
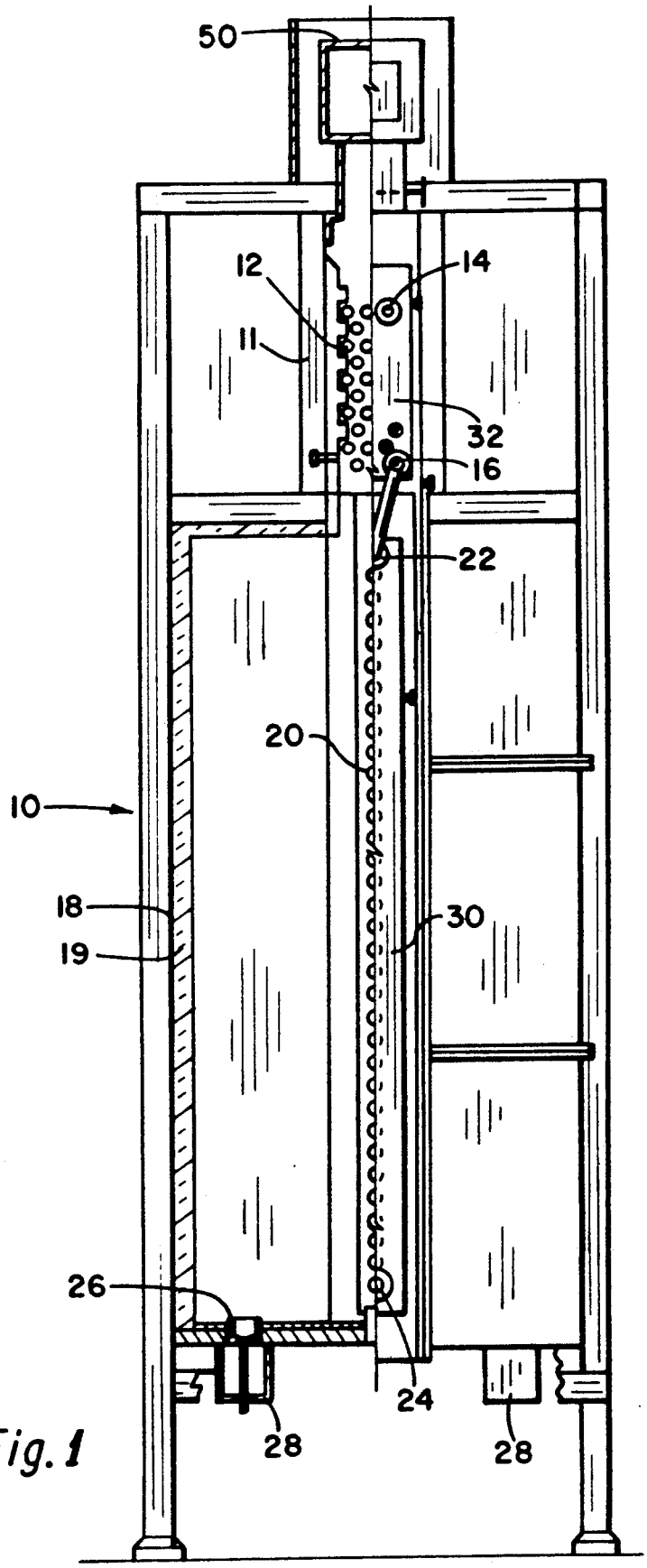
FIG. 1 is an end view of a coke feedstock heater incorporating features of the present invention. In the figure, half of the end view has been cut away to demonstrate internal parts of the heater.
Figure 2:
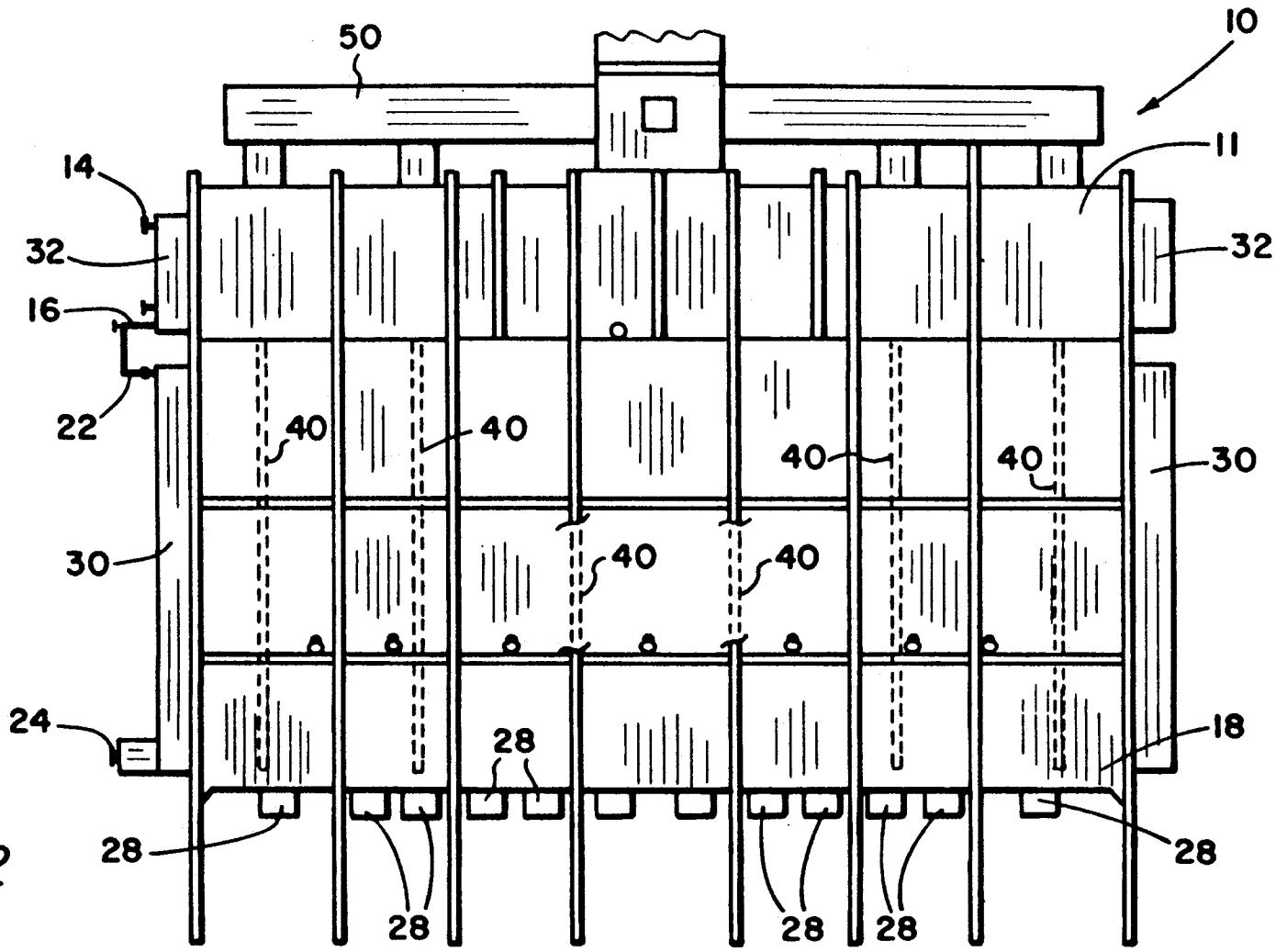
FIG. 2 is an elevational side view of the heater of FIG. 1.
Figure 4:
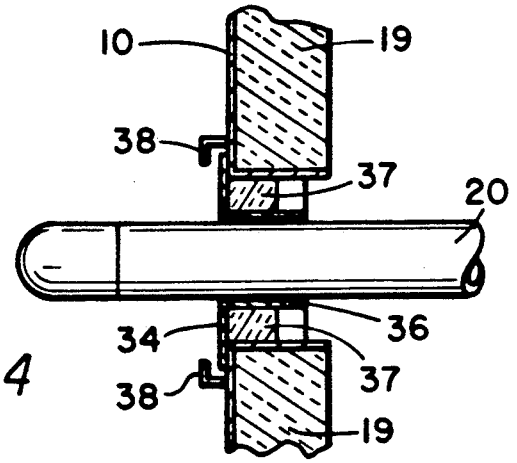
FIG. 4 is a cross-sectional view taken along line A—A of FIG. 3.
Figure 3:
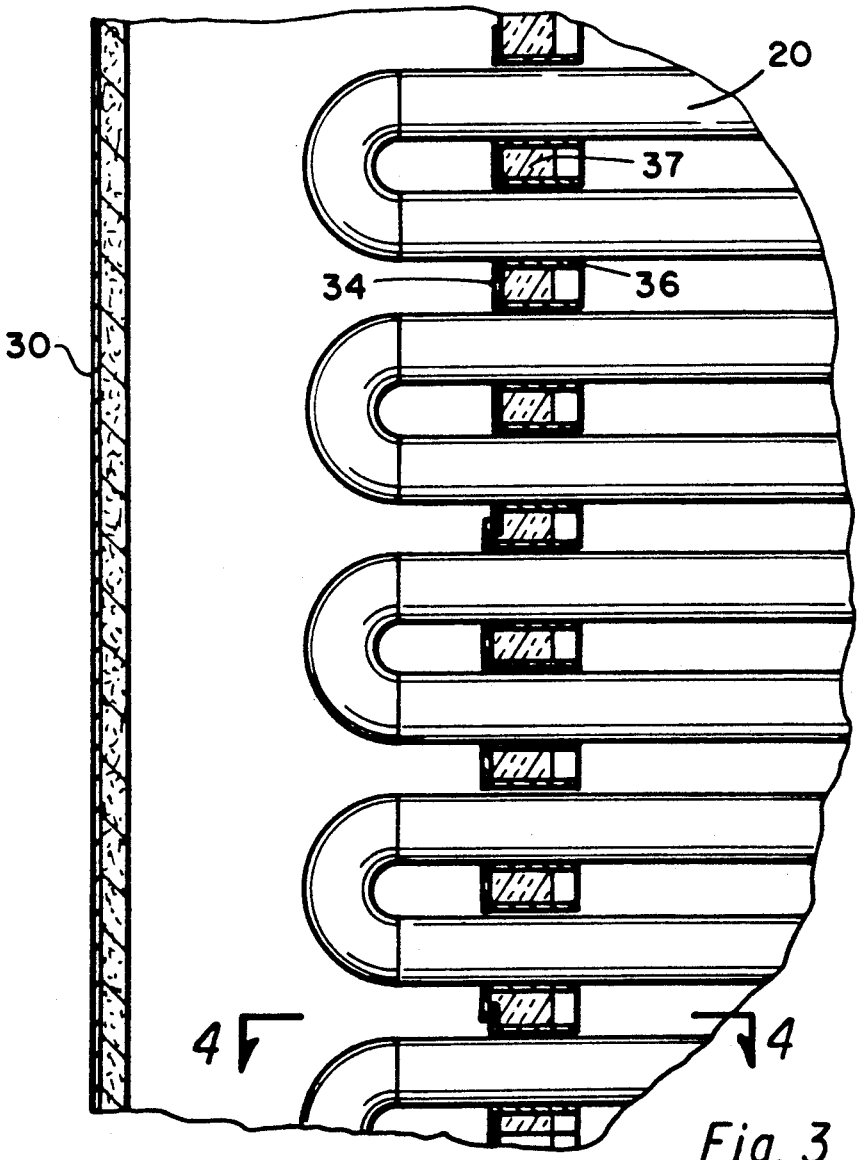
FIG. 3 is a partial sectional view of the header box area of the heater illustrating the tubing of the tube bank and the end supports therefore.
Figure 6:
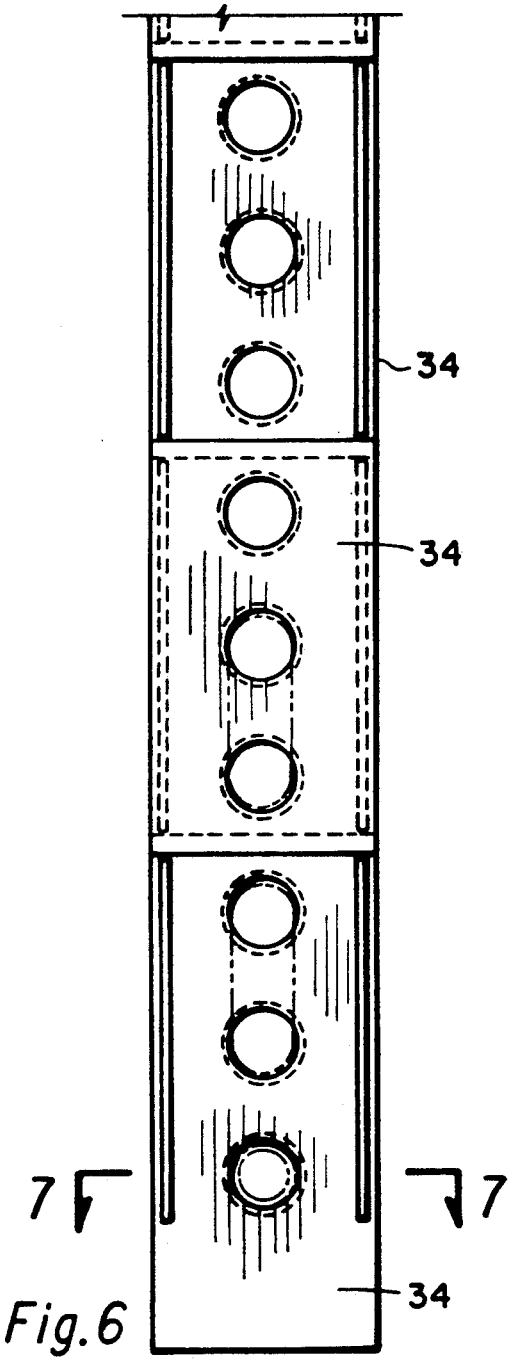
FIG. 6 is a front plan view of some of the end supports as viewed from B—B in FIG. 5.
Figure 7:
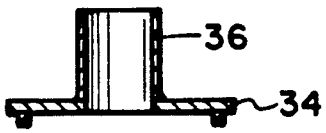
FIG. 7 is a cross-sectional view of a tube sheet end support taken along line C—C in FIG. 6.
Figure 5:
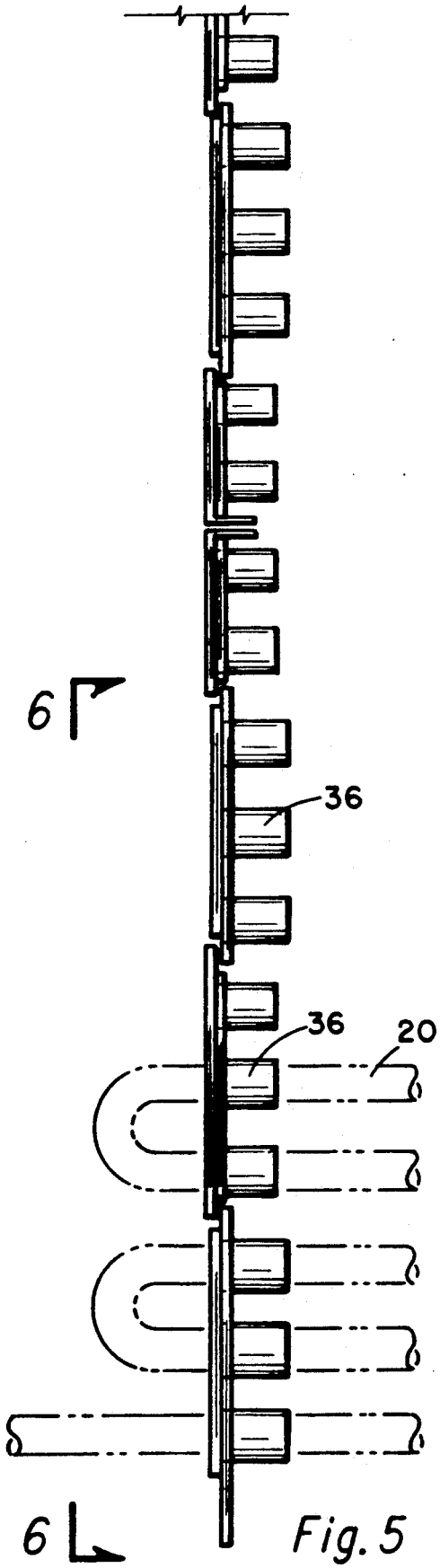
FIG. 5 is a side elevational view of typical tube bank end supports seals with some of the tubing of the tube sheet shown in phantom.

The accompanying FIGS. 1-7 illustrate a preferred embodiment of the present invention. The illustrated embodiment comprises a coking feedstock heater 10 which includes a convection heating section and a radiant heating section. The convection heating section comprises a vessel 11 containing heating tubing 12 having an inlet 14 in an upper portion and an outlet 16 in a lower portion. The tubing extends back and forth throughout the length of the convection heating section.

The radiant heating section comprises a vessel 18 which is insulated with refractory 19 or the like as shown in the art. Suspended within the vessel there is a tube bank 20 comprising a length of tubing which extends from an inlet 22 near the upper end of the radiant heating vessel, back and forth throughout the heating vessel to an outlet 24 near the lower end of the radiant section. The tube bank is suspended within the vessel and is separated from opposite walls of the vessel. A series of burners 26 are located in the lower end of the heating vessel along each side of the suspended tube sheet. The burners are provided with conduit means 28 which provide air to support the combustion of the gas or fuel to be burned in the burners. The exact location of the burners relative to the tube sheet and the side wall can be varied as desired. Generally however, it is desired to position the burner so that the flames therefrom do not erode the wall or bounce off the tubing. In this embodiment the ends of the radiant heater tube bank extend outwardly through slots in each of the radiant heating section. The slots are enclosed by a removable insulated header cover 30. A similar arrangement is present in the convection section which also has a removable insulated header cover 32 which allows for access to the tubes of the convection section.

In the particular embodiment illustrated in the attached Figures, the slots through which the ends of the tubing project are sealed by a particularly novel firebox seal means which also serves as a tube support means. The tube support means comprises a plurality of plates 34 as shown in FIGS. 3-7. Each of the plates contains a ferrule 36 through which the end of a horizontal section of the tubing 20 of the tube sheet passes. The ferrules are preferably surrounded by refractory insulation 37 of some suitable type. The plates 34 are designed so that a plurality are capable of overlapping and moving relative to one another. A channel 38 is provided along the sides of the slot in the radiant heating section and the plates 34 are positioned within this channel so that at least some of the plates will be free for independent movement within the channel in response to the expansion and contraction of the tubing. In some cases, it may be desirable to have at least some of the plates securely mounted relative to the heating vessel. This can be accomplished by field welds of the selected plates.

Within the radiant heating vessel there are further located a number of intermediate radiant tube supports 40 comprising columns containing a plurality of openings through which the tubing of the tube bank passes. Generally the openings of these tube supports are somewhat larger than the outside diameter of the tubing of the tube sheets to allow for expansion and contraction. Further it is preferred that each opening have along its lower edge a lip which extends outwardly to assist in the support of the tubing. The radiant tube supports could be constructed of suitable material, with high alloy steel being currently preferred.

The radiant heating section can also have included therein thermocouples and access doors and observation ports located wherever considered desirable.

In operation, the feedstock that is to be subsequently subjected to coking in a coke drum is introduced into the tubing of the convection section through the inlet 14. The feedstock then passes through the tubing to the outlet 16 in the lower section of the convection section and then to the inlet 22 of the radiant heating section. The feed then travels through the tube bank to the outlet 24 of the radiant heating section. The burners 26 provide flames on each side of the tube bank within the radiant heating section. The hot gases from the radiant heating section pass upwardly from the radiant heating section through an outlet and into the convection heating section. Accordingly, as the feed is initially introduced into the tubing in the convection heating section, it is initially heated by the hot gases of the radiant section and then is exposed to increasingly hotter temperatures as it moves through the radiant heating section to the outlet of the radiant heating section. The particular feed rate and the outlet temperature of the feedstock can be selected as conditions require. Typically, the device would be operated so that the coking feedstock exiting the outlet of the radiant section would be at a temperature in the range of about 850 to about 975 degrees fahrenheit, more preferably about 900 to about 950 degrees fahrenheit.

In a particularly preferred embodiment, the hot gases from the convection section may be passed into ductwork 50 where the gases are employed to heat air which in turn is used to promote the combustion of the gases in the burners within the radiant section. This particular embodiment can involve pumping of air for direct heat exchange with the hot gases from the convection section and then transporting the heated air to the windboxes of the respective burners.

As a result of the double-fired design of the present invention, it has been found that one can increase the flow rate of coking feedstock by three percent or more. In those processes in which steam is employed in conjuction with the coking feedstock, it has also been found that the double-fired coking heater of the present invention will allow one to increase the steam rate. Further, it has been found that the double-fired coking furnace of the present invention can be operated for extended periods of time with no discernible pressure drop occurring which results from coke deposition within the tubing of the radiant heat section.

While the present invention now has been described both in general terms and in regard to an illustrated preferred embodiment, it should be clear that various modifications and variations can be made by those skilled in the art having the benefit of this disclosure without departing from the spirit and scope of the invention.

What is claimed:

1. A delayed coking unit charge heater for heating a feedstock to delayed coking temperature comprising a heating vessel having upper and lower radiant heating sections, a vertical tube bank between and spaced apart from opposite side walls of said vessel through which said feedstock is transported, said tube bank comprising a back and forth continuous path of horizontal tubing suspended generally in a first vertical plane in said vessel and extending from an inlet in said upper radiant section of said heating vessel downwardly to an outlet located in said lower radiant section of said heating vessel, and a plurality of burners located in the lower radiant section of said vessel on each side of said tube bank so as to be capable of providing and directing sheets of flame upwardly on opposite sides of said tube bank, said sheets of flame each individually lying in a plane generally parallel to the plane in which said tube sheet is suspended.

2. A heater according to claim 1 wherein a plurality of portions of the tubing of said tube bank are generally horizontal.

3. A heater according to claim 2 wherein said horizontal portions of said tube bank are spaced apart from the adjacent horizontal portions thereof.

4. A heater according to claim 3 wherein the ends of a plurality of the horizontal sections of the tubing of the tube bank are secured to the wall of the heating vessel by a plurality of tube end supports which are free to move relative to each other and relative to the wall of the heating vessel in response to the expansion and contraction due to changes in the temperature.

5. A heater according to claim 4 wherein there is a channel located on the wall of said heater, said end supports for said tubing comprises a plurality of tube supports comprising plates each having at least one ferrule through which the end of said horizontal section of said tube passes, and wherein a plurality of said tube end supports are mounted for independent movement within said channel.

6. A heater according to claim 1 containing opposite end walls; each end wall having a slot extending through the wall thereof, wherein a plurality of end portions of the tubing back extend outwardly through said slot, wherein there is a channel located on each wall proximate to said slot, and wherein said channel contains a plurality tube end supports comprising plates each having at least one opening through which at least one tubing end portion extends, said plates overlapping so as to seal said slot while supporting the end portions of said tube bank.

* * * * *